United States Patent [19]

Baraut

[11] 4,149,544

[45] Apr. 17, 1979

[54] DEVICE FOR STRIPPING AND SORTING OUT PLANT LEAVES, PARTICULARLY OF TOBACCO PLANTS

[75] Inventor: Pierre Baraut, Paris, France

[73] Assignee: Service D'Exploitation Industrielle des Tabacs et des Allumettes, Paris, France

[21] Appl. No.: 768,090

[22] Filed: Feb. 14, 1977

[30] Foreign Application Priority Data

Feb. 18, 1976 [FR] France ..... 76 04382

[51] Int. Cl.[2] ..... A24B 5/06

[52] U.S. Cl. ..... 130/30 J; 56/330; 130/30 R

[58] Field of Search ..... 130/30 J, 30 R, 31 R; 131/122, 129, 131, 149, 145, 148; 56/330, 27.5

[56] References Cited

U.S. PATENT DOCUMENTS

| | | | |
|---|---|---|---|
| 595,041 | 12/1897 | Butler | 130/30 J |
| 2,989,056 | 6/1961 | LaMotte | 131/149 |
| 3,252,466 | 5/1966 | Swink | 131/149 |
| 3,466,856 | 9/1969 | Rakastraw | 56/27.5 |
| 3,744,224 | 7/1973 | Chapman | 56/27.5 |
| 3,770,112 | 11/1973 | Asfour | 131/149 |
| 3,845,609 | 11/1974 | Whitley | 56/330 |
| 3,962,850 | 6/1976 | Moore | 56/27.5 |
| 4,037,392 | 7/1977 | Taylor et al. | 56/27.5 |
| 4,038,808 | 8/1977 | Patten et al. | 56/27.5 |

*Primary Examiner*—Russell R. Kinsey
*Assistant Examiner*—Paul J. Hirsch
*Attorney, Agent, or Firm*—Jacobs & Jacobs

[57] ABSTRACT

A process for stripping and sorting out the leaves of a plant such as a tobacco plant, comprising the steps of introducing the plant in a stripping element, displacing the assembly formed by the plant and its stripping element in relation to the feed station, performing the progressive stripping of the plant from its leaves as the plant is being moved with the stripping element on the trajectory of the latter, and regrouping the leaves of each foliar level in the corresponding areas of the stripping trajectory.

12 Claims, 4 Drawing Figures

DEVICE FOR STRIPPING AND SORTING OUT PLANT LEAVES, PARTICULARLY OF TOBACCO PLANTS

The present invention relates to the stripping as well as to the sorting out of plant leaves, particularly of tobacco plants, and relates at the same time to the process as well as to device embodying said process.

For a long time, when leaves had to be detached without being damaged, the operation was performed manually. But of course this is a long and very costly way of operating. So a number of devices have been conceived for trying to remedy such disadvantages.

For instance, it is already known to let the plant pass through an aperture with adjustable opening such as a diaphragm. Such a type of process has of course the merit of simplicity, but it lacks in flexibility; moreover the stalk is planed more or less and a greater force is required for driving the plant through the opening; finally the leaves, due to the fact that they are laid flat against the surface where the opening is formed, run the risk of being somewhat bruised.

It is also known to utilize as leaf stripping elements stripping blades or rollers rotating in reverse direction in relation to each other. But such devices require a complex mechanism and an accurate setting. Moreover the leaves are often damaged; and this disadvantage is still increased in the case where the leaves have been previously dried on the stalk since they more or less adhere to each other and will therefore be detached with difficulty and not without damage by said blades or rollers.

A further recent process consists in introducing the plant by its top in a frustoconical wrapper for deflecting the leaves, then in a guiding cylindrical sheath for the plant and to sever in reverse direction in relation to its disposition on the stalk the petiole of each leaf by means of fingers or push-pieces driven in rotation about the stalk.

But this process involves also a rather complex and heavy mechanism. On the other hand the leaves in the course of their being stripped or on the point of their being stripped are deflected and then pushed back in the direction of the plant stalk: leaves run into each other, become tangled and are damaged.

Finally and above all, two major criticisms common to all these processes and devices hereabove discussed consist on the one hand in the fact that by using a single leaf stripping element, the efficiency is not great, and on the other hand in the fact that since such a leaf stripping element operates on a stationary working position, the sorting out of the leaves according to foliar level does not derive in a natural way from the stripping operation.

It is necessary to wait until a tobacco plant introduced in the stripping device is completely stripped of its leaves before the next plant can be introduced. The result is a considerable loss of time and therefore a noticeable reduction of the interest of such devices which do not permit stripping the leaves substantially more quickly than when the work was performed by hand. On the other hand, the stripping operation being carried out in a stationary working position, the leaves fall on top of each other just below the stripping element; the sorting out of the leaves may therefore be made only with the help of complex and cumbersome means.

The object of the present invention is to provide a solution for these two fundamental problems hereabove discussed, i.e. sort out the leaves and improve the stripping efficiency.

According to the present invention, the sorting out of the leaves is therefore obtained by the process consisting in introducing the plant in a stripping element, in moving the assembly formed by the plant and its stripping element in relation to the feed station, in causing a progressive stripping of the plant as it moves with the stripping element along the trajectory of the latter and in regrouping thereby the leaves of each foliar level in the corresponding areas of the stripping trajectory.

The use of several stripping elements within the scope of the present process provides the second desired result, i.e. an improved efficiency. To this effect, several stripping elements are used, one of them in which a plant has been introduced being moved away from the feed station while the following is brought to said feed station.

The efficiency will be further improved by offsetting the stripping element sideways in relation to the direction of the introduction movement of the plant in the stripping element. This solution permits reducing the time interval separating two introduction operations of a plant in a stripping element: before each introduction, the feed station will not have to be freed of a plant taken along its length, but of a cross-section of a plant carried by a stripping element.

As regards the leaf stripping operation taken as such, it will be preferably performed according to a process which is simple and at the same time respects the integrity of the leaves.

According to this preferred process, the plant is introduced lower end forward in the stripping element and a force which is oblique in relation to the plant axis is applied to a point of the petiole of each leaf which is closed to the junction of the leaf on the stalk, said force having a component directed towards the lower end of the plant which is superior to the driving force of said plant.

More particularly, the plant is firmly held in order to avoid its rotation while it is driven in the stripping element, and a helical movement is imparted to the stripping member with characteristics such that the leaves are progressively deflected one by one towards a plane orthogonal to the stalk and then beyond said plane until complete detachment.

This preferred solution offers many advantages: the introduction of the plant, lower end forward, in the stripping element avoids having to clear the top of the stalk of the tobacco plant of the leaves which cover it and facilitates thereby the introduction of the plant in the stripping element; on the other hand, without damaging the leaves, the logical solution is preserved which consists in a stripping operation in reverse direction of the orientation of the leaves on the stalk, due to the fact that the longitudinal component of the force applied on the petiole of each leaf is superior to the force causing the progression of the plant through the stripping element; on the other hand, the force exerted on the petiole of each leaf, successively, being oblique in relation to the plant axis, each leaf is progressively moved away from the stalk of the plant towards a plane orthogonal to said plant, then beyond said plane, relatively far from the stripping element and the other leaves.

The device embodying the process hereabove described may comprise on the one hand, at least one leaf stripping element moving along a given trajectory and driven by a conveyor in translation, preferably lateral, in relation to the introduction movement of the plant in a stripping element, on the other hand means for causing the progression of the plant through the stripping element during said translation.

The leaf stripping element may be a stem of general helical shape whose free end is formed for being inserted between the petiole of each leaf and the plant stalk.

Said stem of general helical shape may be mounted integral of a crown carried by and between two endless chains. Advantageously, this crown is provided with teeth, which are brought into mesh with an endless chain, and is driven in rotation by a toothed rack.

This preferred solution permits ensuring simultaneously the lateral displacement of the assembly formed by the plant and the stripping element in relation to the feed station, and a rotation of the stripping element.

For stopping the stripping element at the feed station and eventually build up a reserve in the case of a plurality of stripping elements, a guiding slide for the stripping element may be foreseen between the downstream portion of the driving area of the chain and the feed station, said slide comprising a stopping means for said element.

Taking into account the stripping element trajectory, a channel may be provided which is formed by the interval between two endless belts whose trajectory is oblique in relation to that of the stripping element.

The two endless belts are such that they prevent the plant from rotating and that they maintain it in a plane orthogonal to the stripping element trajectory. The obliqueness of the channel in relation to the trajectory of the stripping elements causes the necessary progression of the stalk through the stripping element, the speed of said belts being appropriately set in relation to the speed of the chain so that the plant remains parallel to itself during its progression.

The following description made with reference to the accompanying drawing is only a non limitative example of the device according to the invention. On this drawing.

Figure 1:
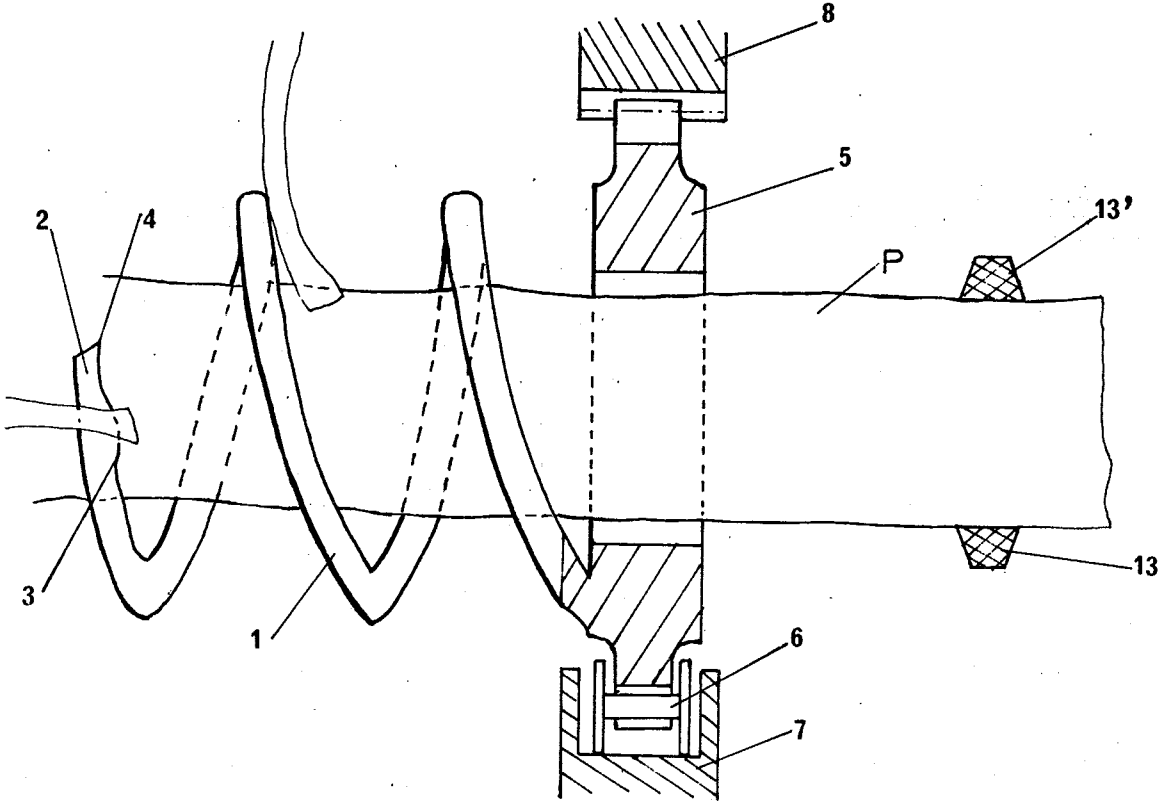
FIG. 1 is a view at a large scale of the stripping element shown in cross-section along line II-II of FIG. 2.

As may be seen from FIG. 1, the stripping element is made of a stem 1 of helical shape and appropriate dimensions for receiving the plant to strip. For ensuring its correct insertion between the plant stalk and each leaf, the element free end 2 is formed with a buldging part 3 on its inner face, and its leading edge 4 consists of a cutting edge intended for cutting the petiole of a leaf in the case where end 2 has not passed between said petiole and the plant stalk.

Moreover, the pitch of the spirals of the helix formed by stem 1 as well as the angle of said helix are calculated in such manner that the force exerted by a spiral on the petiole of each leaf is oblique in relation to the plant P axis and that the longitudinal component of said force is in the same direction, but superior to the force which causes the longitudinal progression of the plant through the stripping element.

The stripping element 1 is mounted integral of a crown gear 5 which has an inside diameter slightly superior to the maximum diameter of the stalks of the plants to be stripped of their leaves.

The crown gear 5 is in mesh on the one hand with the links of an endless chain 6 driven continuously and guided by the fixed frame 7 and on the other hand with the teeth of a fixed toothed rack 8. This chain and toothed rack assembly forms the transfer channel for the stripping element and ensures at the same time its linear as well as its rotative movement.

Figure 2:
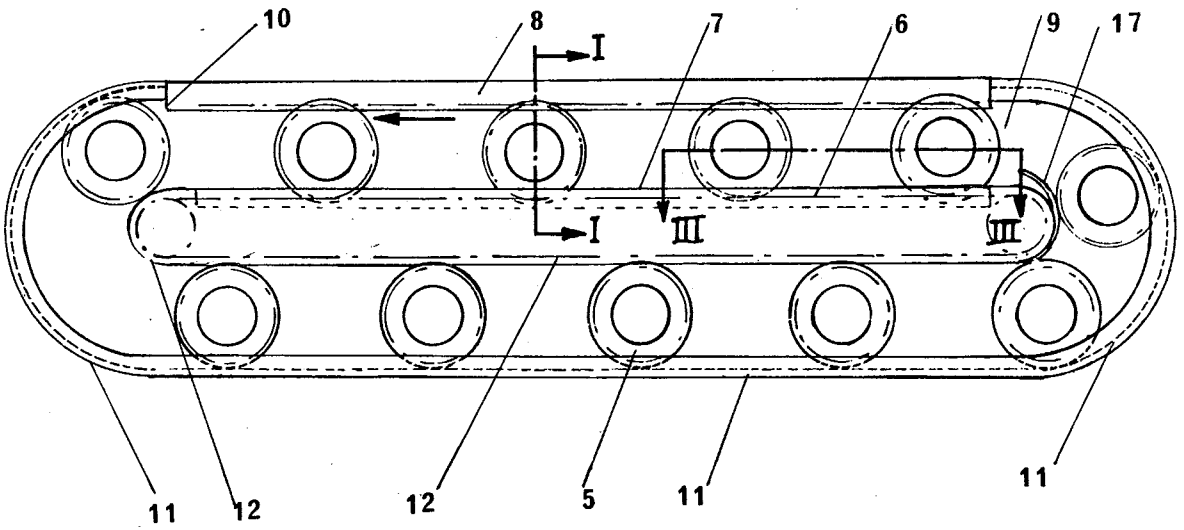
FIG. 2 is a lateral elevation view of the whole device.

FIG. 2 shows more particularly the trajectory followed by crown gear 5 provided with the stripping element 1. This trajectory consists on the one end in an active portion in which the driving control of the stripping element is positive and where the plant is stripped of its leaves, and on the other hand in an inactive portion in which said element is brought back to the upstream end of the active portion where the feed station 9 is located. The active portion of the trajectory is therefore downstream stream of the feed station 9 and consists in the upper strand of chain 6 and in the toothed rack 8. It ends at the downstream end 10 of said toothed rack after the plant is completely stripped of its leaves.

The toothed rack 8 is then replaced by a slide 11 with which the lower strand of chain 6 forms the inactive portion of the element trajectory.

Between the downstream end of the inactive portion and the upstream end of the active portion, a slide 12 covers the return section of chain 6 and thereby allows to slow down the element until it reaches the feed station 9 by letting it slide between 12 and 11.

A retaining system 17 is provided at the feed station such as a spring blade or any other similar means, causing the immobilization of the stripping element in order to favour the introduction of the plant in said element. This retaining system 17 prevents crown gear 5 from inadvertently engaging the toothed rack, the release of the stripping element being started by the introduction (manual or automatic) of the plant in said element.

Figure 4:
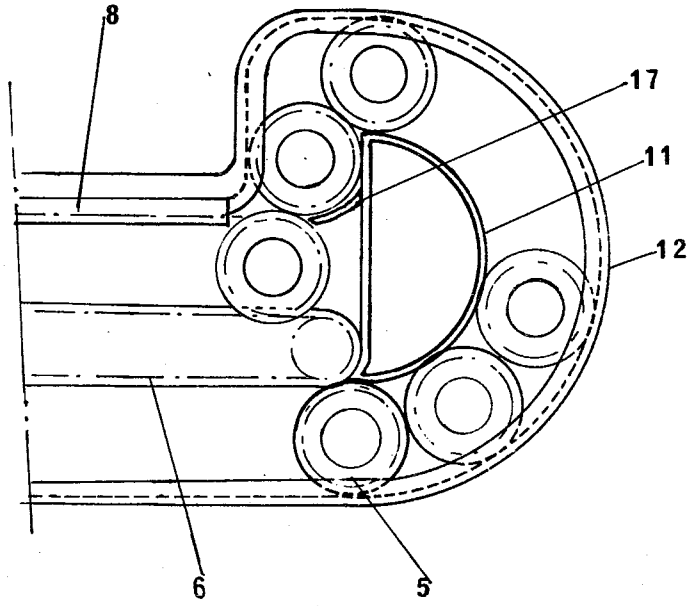
FIG. 4 shows an alternative of the upstream end of the channel of the device.

In the case of a plurality of elements moving simultaneously on the trajectory, the two slides 11 and 12 may allow the building up of a more or less important reserve of elements. The shape of these two slides (for instance FIG. 4) is function of the work tempo end of the flexibility of said tempo which one contrives to follow.

Figure 3:
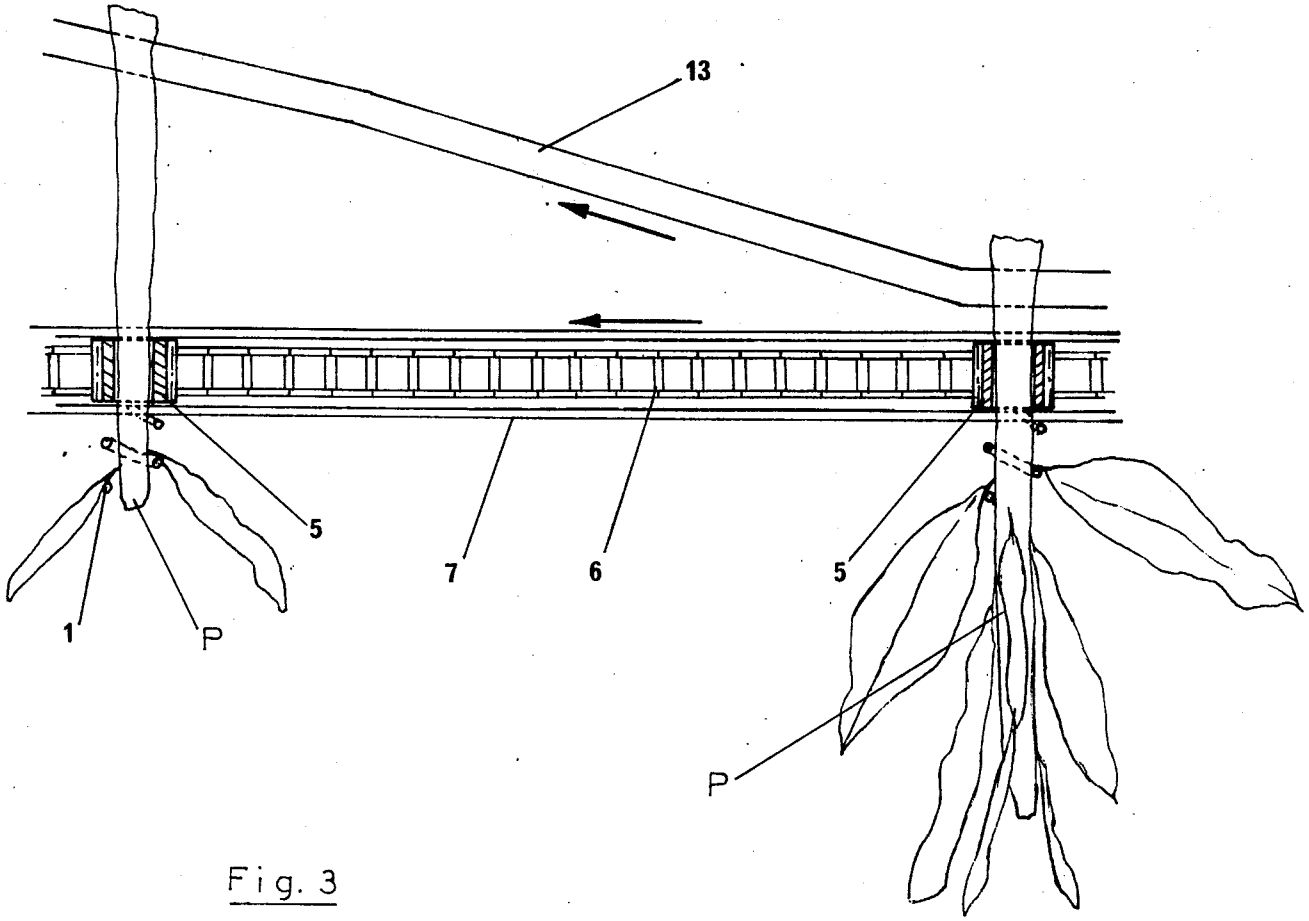
FIG. 3 is cross-sectional view of the whole device along line III of FIG. 2.

As is seen from FIGS. 1 and 3, two belts 13, driven continuously so that their active strands move in the same direction as chain 10, are disposed on the other side of the stripping element 1 in relation to the channel formed by 6 and 8. The space between these two belts is such that the lower end of the tobacco plant P is squeezed between them and therefore supported and driven by them.

The trajectory followed by belt 13 is oblique in relation to that of the stripping element in order to move the plant longitudinally through said element.

The speed of belt 13 is set in function on the one hand of the angle formed by the trajectory of the belts and that of the stripping element driven by chain 6, and on the other hand of the progression speed of said chain 6, in order to maintain the plant in an orthogonal position in relation to the trajectory of the stripping elements along the whole active portion of the trajectory of the latter. It may also be foreseen to use several successive sets of belts in order to adjust the speed of said belts as a function of the distribution of the leaves on the plant stalk, from lower end to top.

The device operates in the following manner, notwithstanding the fact that the tobacco is picked fresh or that it has already dried up on the stalk.

A stripping element being kept stationary in the feed station 9, an operative introduces the plant P, lower end forward, inside the stripping element 1 of helical shape. The lower end of plant P is then squeezed between the two belts 13 after having crossed the crown gear 5. When released from the retaining system 17, said crown 5 comes into mesh with the toothed rack 8 while engaging at the same time the links of chain 6. The Whole assembly moves then laterally in relation to the feed station on the transportation channel formed by 6 and 8, whilst driving in rotation the crown gear 5 and, by way of consequence, the stripping element 1. On the contrary, the tobacco plant whose lower end is squeezed between belts 13 cannot turn round and the trajectory of said belts 13 moving away from that of the crown gear, the plant is progressively moved longitudinally while being maintained parallel to itself.

The free end 2 of the stripping element, due to its shape and during its movement around the plant stalk, slides between the petiole of each leaf and the plant stalk. The combination of the rotary movement of said end 2 and the longitudinal movement is proper to plant P causes a progressive deflection of the petiole of each leaf towards a plane orthogonal to the plant, and beyond said plane until complete detachment of the leaf by the helix spirals, during which time end 2 has lifted one or more of the following leaves.

However, it may happen that due to the deformation of the tobacco plant stalks, or to any other cause, the end 2 is not introduced between the petiole of the leaf and the plant stalk; in such a case the cutting edge 4 passes above said petiole and cuts it off.

The length of the active portion of the stripping element trajectory, that is practically the length of the toothed rack 8, is such that the plant, being introduced at station 9, reaches the downstream end of the rack completely stripped of its leaves. Then it extracts itself from the crown gear and subsequently from belt 13. The detached leaves are spread out regularly as the stripping operation proceeds in a plane situated below the stripping elements trajectory. For sorting the leaves out, it is only necessary to regroup them in determined areas corresponding to the different foliar levels.

Then, the stripping element is brought back by chain 6 to station 9.

If an improved efficiency of the stripping process is required, several stripping elements should be used.

In the case where the work tempo is not only high but also irregular, a reserve of stripping elements may be formed upstream of the feed station 9: it allows the operative to speed up his working tempo for a certain time and then have a momentary different occupation, for instance building up a reserve of plants to be stripped of their leaves.

What I claim is:

1. A device for stripping tobacco leaves from the stalk of tobacco plant comprising an annular member operable to receive said stalk for passage therethrough; means for rotating said annular member; a stripping element disposed on said annular member and operable upon rotation of said annular member to apply to each leaf petiole near the junction of the leaf and stalk a force oblique to the axis of the stalk; and means for advancing said stalk through said annular member along the axis of the stalk and in a direction such that said stripping element first engages the bottom most leaves of said plant.

2. A device according to claim 1 wherein said annular member rotatably advances along track means the path of which is perpendicular to the axis along which said stalk advances through said annular member.

3. A device according to claim 2 comprising a plurality of said annular members on said track.

4. A device according to claim 1 wherein said stripping element is of helical configuration.

5. A device according to claim 4 including means operable to restrict rotation of said stalk as said annular member and associated helical stripping element are rotated.

6. A device according to claim 5 wherein said annular member rotatably advances along track means the path of which is perpendicular to the axis along which said stalk advances through said annular member.

7. A device according to claim 5 comprising a plurality of said annular members in said track.

8. A device according to claim 7 wherein the annular element is toothed and said annular member rotating means comprises a driving chain and a rack operable to engage said toothed annular member.

9. A device according to claim 8 wherein said track mans includes a feed station, a guiding slide downstream of the feed station and annular member stopping means.

10. A device according to claim 8 wherein each of said stripping elements is a helical stem integral with said toothed annular member, the free end of said helical stem being formed for insertion between the stalk and each leaf of said plant.

11. A device according to claim 10 wherein the free end of the helical element has a cutting leading edge.

12. A device according to claim 10 wherein the helical element on an active portion of its extremity is enlarged on the side in contact with the stalk.

* * * * *